US006500096B1

(12) United States Patent
Farney

(10) Patent No.: US 6,500,096 B1
(45) Date of Patent: Dec. 31, 2002

(54) FOOTBED FOR ELLIPTICAL EXERCISE MACHINE

(75) Inventor: Michael Kent Farney, Broken Arrow, OK (US)

(73) Assignee: Sinties Corporation, Inc., Tulsa, OK (US)

( * ) Notice: Subject to any disclaimer, the term of this patent is extended or adjusted under 35 U.S.C. 154(b) by 0 days.

(21) Appl. No.: 09/728,606

(22) Filed: Nov. 29, 2000

(51) Int. Cl.[7] ..... A63B 69/16; A63B 22/04
(52) U.S. Cl. ..... 482/52; 482/51; 482/70
(58) Field of Search ..... 482/51, 52, 53, 482/57, 70, 71, 79, 80

(56) References Cited

U.S. PATENT DOCUMENTS

| | | | | |
|---|---|---|---|---|
| 4,550,908 A | | 11/1985 | Dixon | |
| 4,708,338 A | | 11/1987 | Potts | |
| 5,020,793 A | * | 6/1991 | Loane | 482/71 |
| 5,040,786 A | | 8/1991 | Jou | |
| 5,114,388 A | | 5/1992 | Trulaske | |
| 5,147,257 A | * | 9/1992 | Loane | 482/71 |
| 5,490,818 A | | 2/1996 | Haber et al. | |
| 5,536,225 A | | 7/1996 | Neuberg et al. | |
| 5,584,780 A | | 12/1996 | Lin | |
| 5,591,107 A | | 1/1997 | Rodgers, Jr. | |
| 5,681,245 A | | 10/1997 | Lin | |
| 5,690,589 A | | 11/1997 | Rodgers, Jr. | |
| 5,743,832 A | | 4/1998 | Sands et al. | |
| 5,749,811 A | * | 5/1998 | Wilson | 482/71 |
| 5,820,524 A | | 10/1998 | Chen | |
| 5,913,751 A | | 6/1999 | Eschenbach | |

* cited by examiner

*Primary Examiner*—Stephen R. Crow
(74) *Attorney, Agent, or Firm*—Fellers, Snider, Blankenship, Bailey & Tippens, P.C.

(57) ABSTRACT

The present invention includes a footbed for an elliptical exercise machine designed to pivot during the elliptical range of rotation thereby allowing the user's foot to dictate the angle of the footbed throughout that entire path of rotation. The footbed assembly includes, generally, a platform, two posts, footpad, saddle, and pads. The platform or plate mount is mounted to the elongated rails of the elliptical machine with the posts extending vertically therefrom. The footpad includes wings extending from on each side. The wings are bent upwardly such that they extend above the surface of the footpad. The upward point of the wings are pivotally secured to the posts such that the pivot point is a distance above the plane of the footpad.

8 Claims, 8 Drawing Sheets

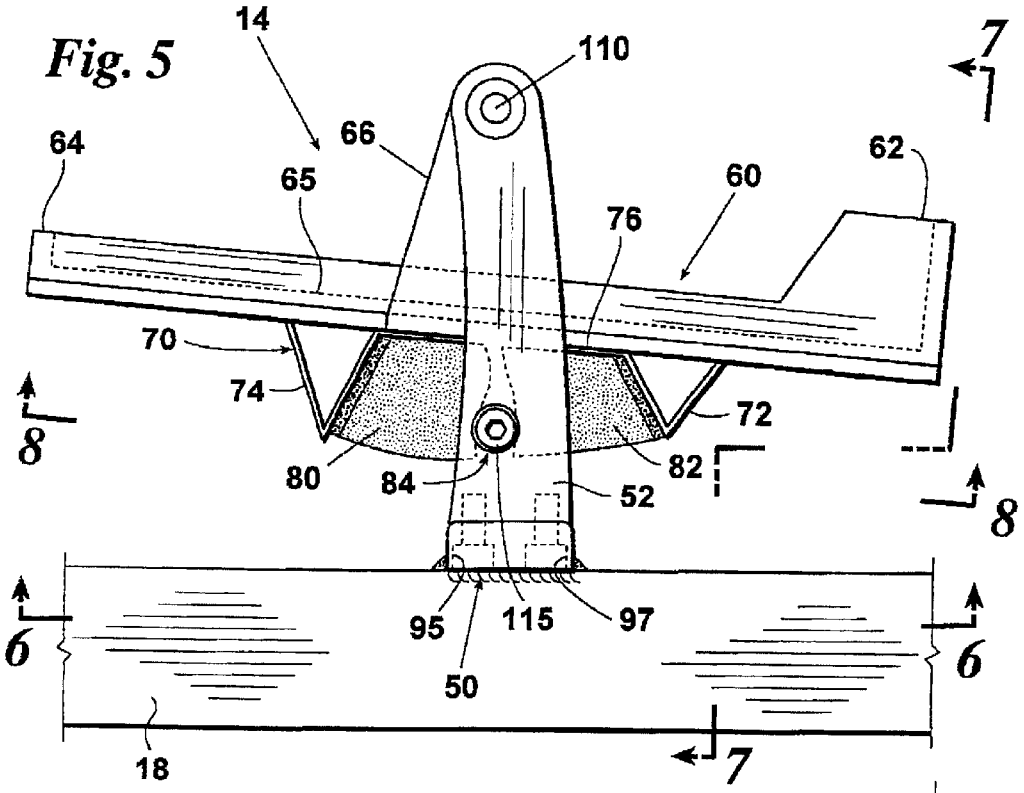
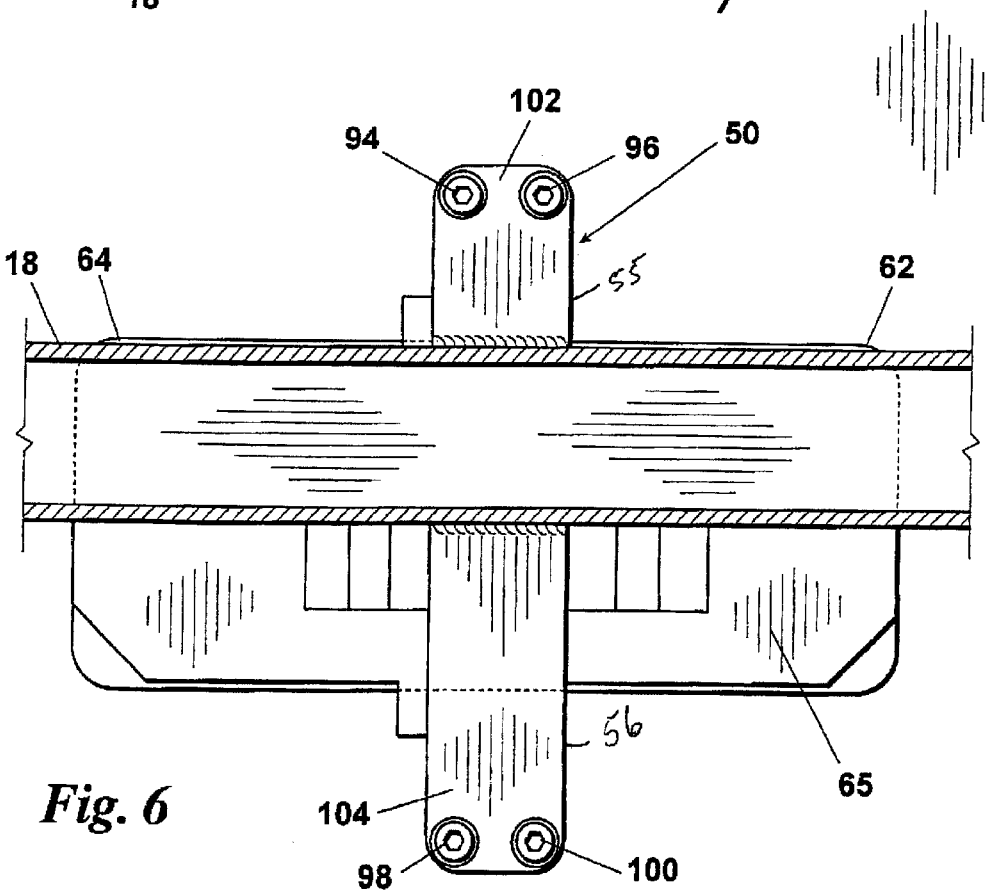
Fig. 6

FOOTBED FOR ELLIPTICAL EXERCISE MACHINE

BACKGROUND OF THE INVENTION

1. Field of the Invention

This invention relates, generally, to exercise devices and to elliptical exercise devices specifically.

2. Background of the Invention

The footbed of an elliptical exercise machine is the assembly on which the user's foot rests which moves in an elliptical orbit throughout the full motion of the device. The user's foot/ankle follows the footbed throughout this range of motion. The elliptical range of motion is derived conventionally from securing the footbed to a set of rails which roll back along a frame on one end and are connected to a bicycle crank on the other which rotates in a circular geometry. With the footbed secured to the rail along its length, an elliptical range of motion is derived from the fact that one end of the rail is rotating in a circular geometry (moving vertically as well as horizontally) and the other is rolling horizontally. As a result, the pitch or angle of the footbed will dictate the pitch/angle of the user's foot/ankle throughout the entire range of motion. In other words, a footbed which is level will remain level throughout this motion while a footbed that is fixed at an angle will remain at that angle throughout the entire elliptical path of rotation.

The theory behind an elliptical exercise machine is to derive a range of motion which simulates the natural stride of human biokinetic motion while causing minimal impact to the user. Impact/shock is a result of repetitive striking of the ground by the exerciser's foot coupled with the force derived from the exerciser's body weight. Repetitive impact commonly causes injury, wear, or at least fatigue to the feet, ankles, and legs. With an elliptical exercise machine, since the footbed is fixed to the rail, the foot of the user (an thereby the weight) is constantly supported by the rail. Therefore, the belief is that there is little or no repetitive shock/impact to the user.

One problem that exists with conventional footbed systems in elliptical exercise machines is that since the footbed is fixed to the rail, it will remain in that fixed position throughout the path of rotation of the rail. A footbed which is level will remain level through this motion, while a footbed that is set at an angle will remain at that angle throughout the entire elliptical path of rotation. Since the footbed is fixed, it does not effectively simulate the natural flexation of the foot/ankle during the exerciser's normal stride. The result is that this unnatural stride may cause the user to terminate the use of the machine prior to achieving a maximum workout or avoid the machine altogether. A need, therefore, exists for a device which allows the foot/ankle of the user to change position during the path of rotation in a manner which approximates a natural stride of the user.

SUMMARY OF THE INVENTION

The present invention includes a footbed for an elliptical exercise machine designed to pivot during the elliptical range of rotation thereby allowing the user's foot to dictate the angle of the footbed throughout that entire path of rotation. Simulation of the natural stride of the user is thus obtained thereby creating a more comfortable piece of exercise equipment for the user and allowing the user to obtain a maximum exercise benefit from its use. The footbed assembly includes, generally, a platform, two posts, footpad, saddle, and pads. The platform or plate mount is mounted to the elongated rails of the elliptical machine with the posts extending vertically therefrom. In the preferred embodiment, the footpad includes wings extending from on each side. The wings are bent upwardly such that they extend above the surface of the footpad. The upward point of the wings are pivotally secured to the posts such that the pivot point is a distance above the plane of the footpad.

The saddle is secured, preferably welded to the underside of the footpad and is of an elongated "W" shape. In the preferred embodiment, two pads are secured to the inside of the "W" such that they surround (or sandwich) a shaft extending between the posts beneath the plane of the footpad. The pads thereby provide resistance and spring to the footpad and act to bias the footpad to a home or relaxed position. The pads in this way provide the user a feel of greater control of the footpad during operation. Since the wings of the footpad are secured to the posts at a pivot point above the plane of the footpad, the footpad is free to pivot subject to the restriction of the pads.

An object of invention is therefore to create a footpad for an elliptical exercise machine which is free to pivot and thereby follow the natural foot/ankle position of the user which simulates the user's natural stride. Other objects will become apparent from the drawings and the detailed description.

BRIEF DESCRIPTION OF THE DRAWINGS

FIG. 5 is a side view of the footbed assembly of the present invention.

FIG. 6 is a view taken along line 6—6 of FIG. 5 depicting the underside of the footbed below the rail.

DETAILED DESCRIPTION OF THE PREFERRED EMBODIMENT

Figure 1:
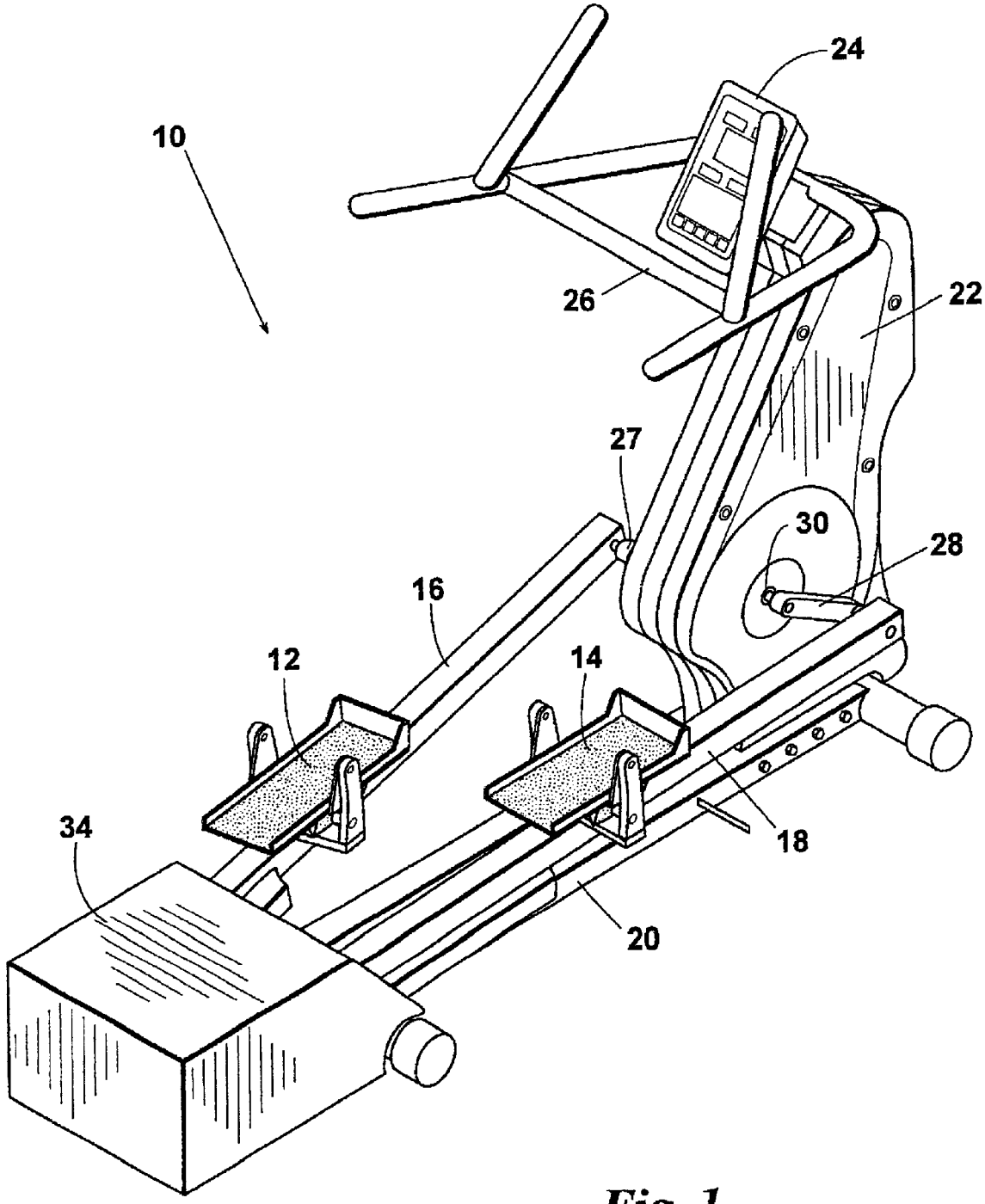
FIG. 1 is an isometric view of an elliptical exercise machine including footbed assemblies of the present invention thereon.

In the present invention, FIG. 1 depicts an elliptical exercise machine 10 including footbed assemblies 12 and 14 of the present invention thereon. Footbed assemblies 12 and 14 are shown mounted to rails 16 and 18 respectively. Elliptical exercise machines such as machine 10 are known in the industry with the exception of footbed assemblies 12 and 14, and include a frame 20, a housing 22, control panel 24 and handle bars 26. Housing 22 includes the operating mechanism encased inside supported by frame 20. Crank arms 26 and 28 rotate in circular orbit around a central axle 30 extending through crank arms 27 and 28 on each side of housing 22. At their rearward end, rails 16 and 18 roll along segments of frame 20. Such engagement can best be seen in FIG. 3 wherein rail 18 including roller 32 secured in its trailing end depicted in rolling engagement with frame 20. Rail 18 including roller 32 is shown in four different position (3 in phantom) along frame 20. The path of travel of rail 18 is discussed further below. Referring back to FIG. 1, the trailing ends of rails 16 and 18 are covered by enclosure 34.

Referring next to FIG. 5, a side view of the footbed assembly 14 of the present invention will be next generally described. It is understood that footbed assembly 12 of FIG. 1 is identical to footbed assembly 14 with the exception of the direction of the mounting to their respective rails 16 and 18.

Figure 3:
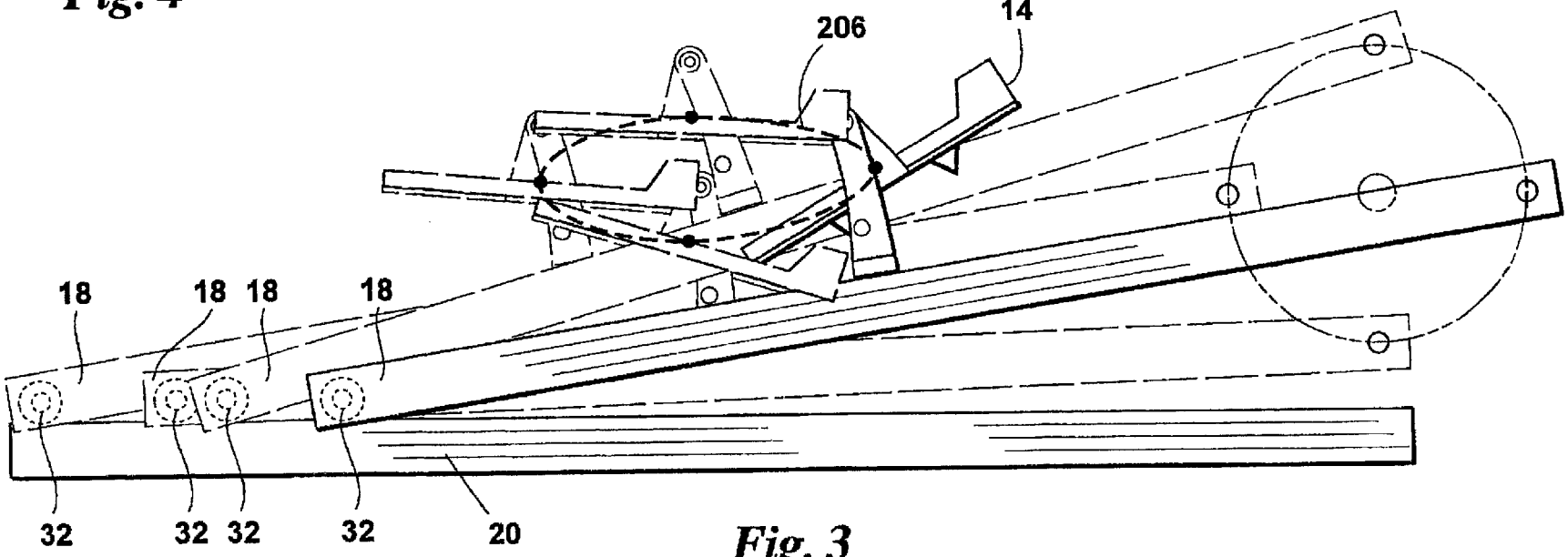
FIG. 3 is a side view representation of the elliptical path of rotation of the pivotal footbed assembly of the present invention.

Footbed assembly 14 as shown in FIG. 3 includes, generally, plate mount 50, post 52, footpad 60, saddle 70, pads 80, 82, and shaft 84.

Plate mount 50 is fixed to rail 18 and provides a supporting platform for the remainder of footbed assembly 14 extending upwardly therefrom. Taking FIG. 5 in combination with FIG. 6, it can be seen that plate mount 50 is a bar fixed to the top of rail 18. Plate mount 50 includes short segment 55 and long segment 56 fixed to rail 18. Securing plate mount 50 onto rail 18 provides advantages over other means of providing a support platform for footbed assembly 14 such as by bolting through rail 14. One significant advantage is the reduced cost of manufacturing of a single bar welded to rail 14 as opposed to multiple plates which must be aligned and bolted through rail 14. Although welding is used and described throughout this preferred embodiment, it should be understood that other fastening means are contemplated.

In the preferred embodiment, plate mount 50 is secured to rail 18 asymmetrically such that a short segment 55 and a long segment 56 of plate mount 50 are formed. This can be best seen in FIG. 7. Short segment 55 and long segment 56 allow rails 16 and 18 and frame 20 to which they interrelate to be spread farther apart for greater stability of the elliptical machine while maintaining a comfortable distance between footpad 12 and 14. This is because long segment 56 allows footbed assembly 14 extending therefrom to be moved closer toward opposed footbed assembly 16 (FIG. 1). The distance between footbeds 14 and 16 will be determined by the length of long segment 56 (and the alternately respective lengths of short segment 55 and long segment 56).

Figure 7:
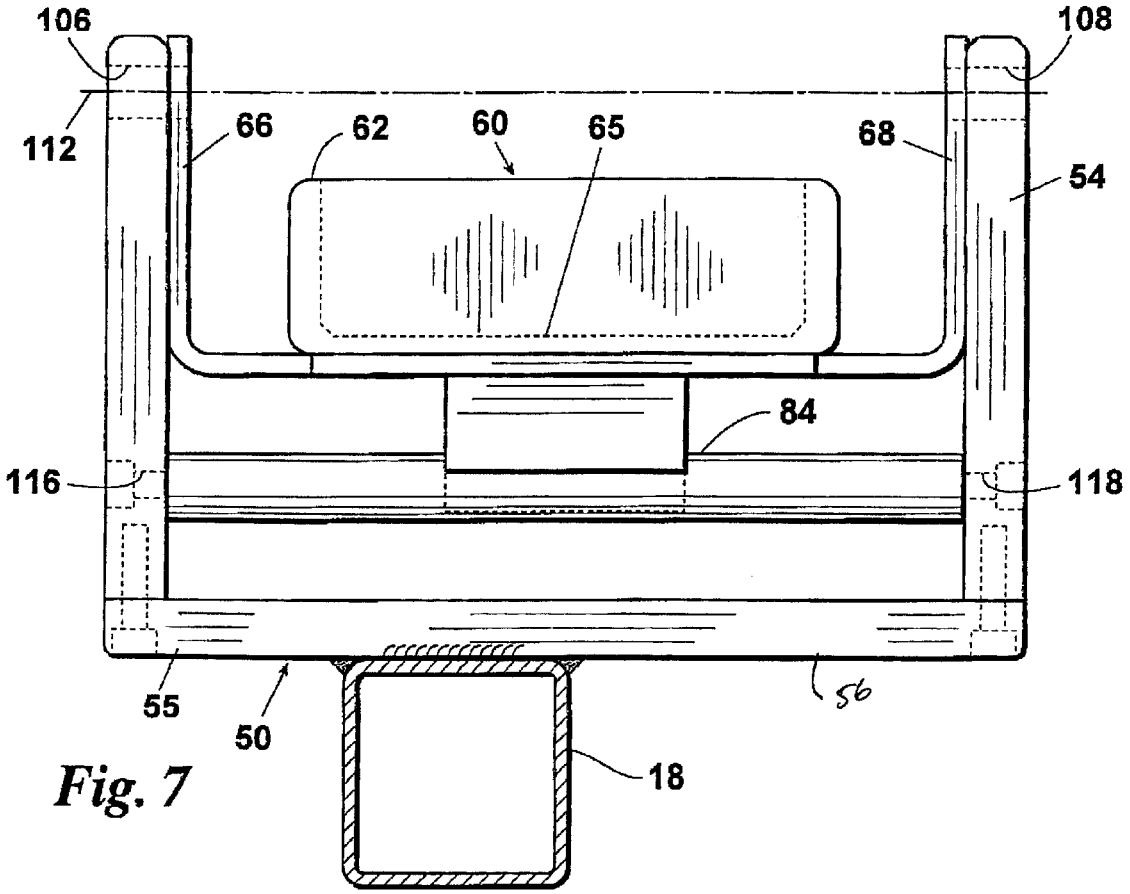
FIG. 7 is a view taken along line 7—7 of FIG. 5 depicting the front view of the footbed of the present invention.

Now taking FIG. 5 in combination with FIG. 7, it can be seen that a pair of posts 52 and 54 extend from plate mount 50 and are secured thereto such that plate mount 50 provides a base or platform for posts 52 and 54. Post 52 extends from short segment 55 (FIG. 5) and secured by a pair of set screws 94 and 96 (FIG. 6) which are countersunk in short segment 55 through countersunk holes 95 and 97 drilled and tapped through short segment 55 and into post 52 (FIG. 5). Post 54 is secured to long segment 56 opposite post 52 (FIG. 6) by set screws 98 and 100 through holes 99 and 101 countersunk, drilled and tapped through long segment 56 and into post 54 (FIG. 7). In the preferred embodiment, posts 52 and 54 are secured to short segment 55 and long segment 56 respectively on tongues 102 and 104 which extend outwardly from short segment 55 and long segment 56 respectively (FIG. 6). Posts 52 and 54 extend upwardly from plate mount 50 at a 90° angle from platform 65.

Footpad 60 includes toe 62, heel 64 and wings 66 and 68 (FIG. 7) extending upwardly therefrom such that a platform 65 is a planer surface bounded by toe 62 and heel 64 along the length of and along a parallel longitudinal axis as rail 18 and bounded by wings 66 and 68 on a transverse axis perpendicular to the longitudinal axis of rail 18. Wings 66 and 68 are, in the preferred embodiment, integral with the remainder of footpad 60 or could include a separate piece attached such as by welding to the platform 65 beneath footpad 60 in an alternate embodiment. Wings 66 and 68 are bent upward from footpad 60 to form approximately a 90° angle with platform 65. Wings 66 and 68 are of a length so that when bent upwardly they are equal to and preferably extend above platform 65 of footpad 60. Wings 66 and 68 are secured to posts 52 and 54 respectively so as to pivot therefrom from a pivot point above the platform 65 of footbed 60. As can be seen in FIG. 7, a hole 106 is drilled through wing 66 and post 52 into which a pin or dowel is inserted such that wing 66 is capable of pivoting about the pin (110 of FIG. 6). A second hole 108 is drilled through wing 68 and post 54 to receive a second pin such that wing 68 is capable of pivot about this pin with respect to post 54. Accordingly, footpad 60 and platform 65 thereof are supported entirely from posts 52 and 54 such that platform 65 is capable of pivot or swing about pivot points 112 and 114 along the longitudinal axis of platform 65.

A shaft 84 extends between post 52 and post 54 beneath platform 65 of footpad 60. Shaft 84 is fixed between posts 52 and 54 by set screws countersunk in posts 52 and 54 through countersunk holes 116 and 118 drilled and tapped through posts 52 and 54 respectively. Set screw 115 is shown extending through post 52 in FIG. 5. Referring next back to FIG. 5, saddle 70 shall next be described. Saddle 70 is a piece of rigid material (preferably metal) secured to the bottom of footpad 60. Saddle 70 may be secured to footpad 60 by any suitable means such as welding, or adhesive, or both. Saddle 70 is of an elongated "W"-shape and includes discreet "V"-segments 72 and 74. As can be seen in FIG. 5 V-segment 72 is smaller or shallower than V-segment 74. Bridge 76 spans the distance between V 72 and V 74.

Figure 8:
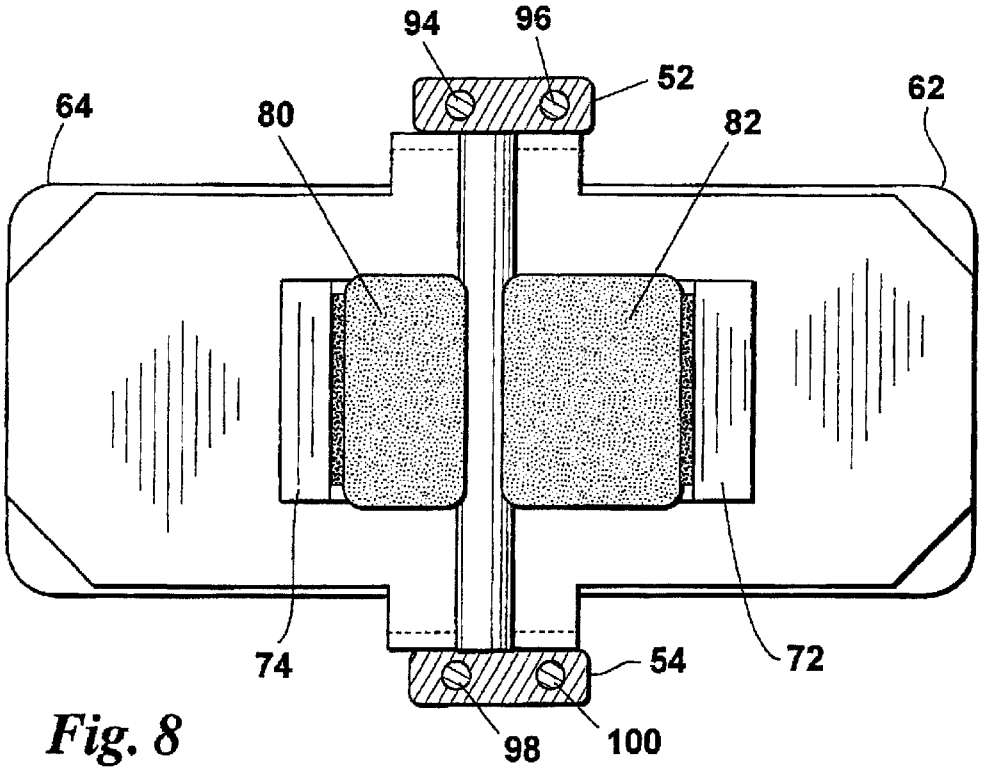
FIG. 8 is a view taken along line 8—8 of FIG. 5 depicting the underside of the footbed above the rail to show the saddle.

Referring next to FIG. 5 in combination with FIG. 8, a pair of pads 80 and 82 are affixed to saddle 70 so as to surround or "sandwich" shaft 84 therebetween. Pad 80 is adhered to V 74 on its length facing V 72 as well as bridge 76 preferably by velcro or adhesive. Likewise, pad 82 is adhered to the surface of V 72 facing V 74 as well as bridge 76, preferably by velcro or adhesive. Pads 80 and 82 supported by V's 74 and 72, respectively, bias against shaft 84 in opposite directions. Pads 80 and 82 also thereby act to cushion footpad 60 as it pivots along the longitudinal axis of platform 65 and spring footpad 60 to a natural or rest position such as is shown in FIGS. 5–8. The rest position is determined by the respective lengths of pads 80 and 82 and can be set to be parallel with rail 18 such as shown in FIG. 5 or rotated up or down at any desired angle. It is believed that in the preferred embodiment, footpad 60 would be positioned at rest at an angle of approximately 5° with respect to the horizontal. Velcro is the preferred method of attachment for pads 80 and 82 so that pads 80 and 82 may be replaced when worn or torn from extended pressure against shaft 84.

Figure 9:
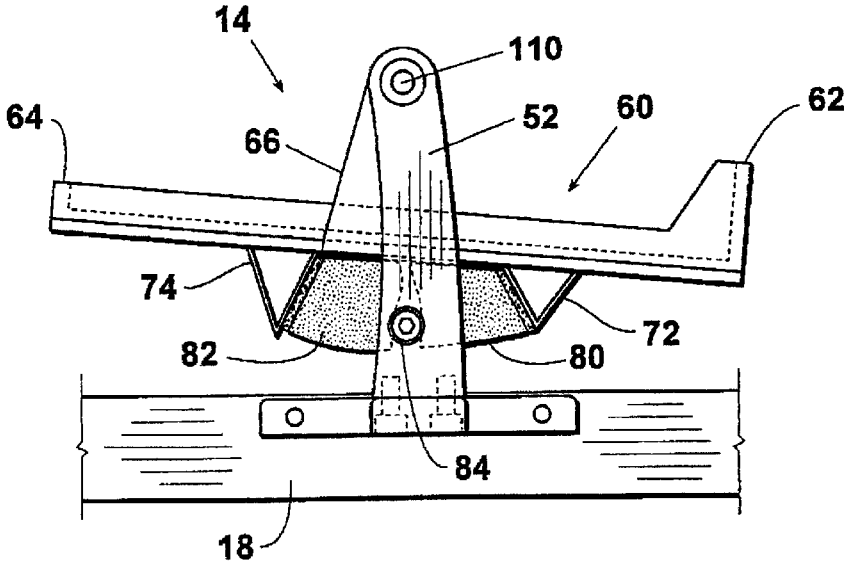
FIG. 9 is a side view of the footbed assembly o the present invention with the interrelationship between the pads and the shaft shown in phantom.
Figure 10:
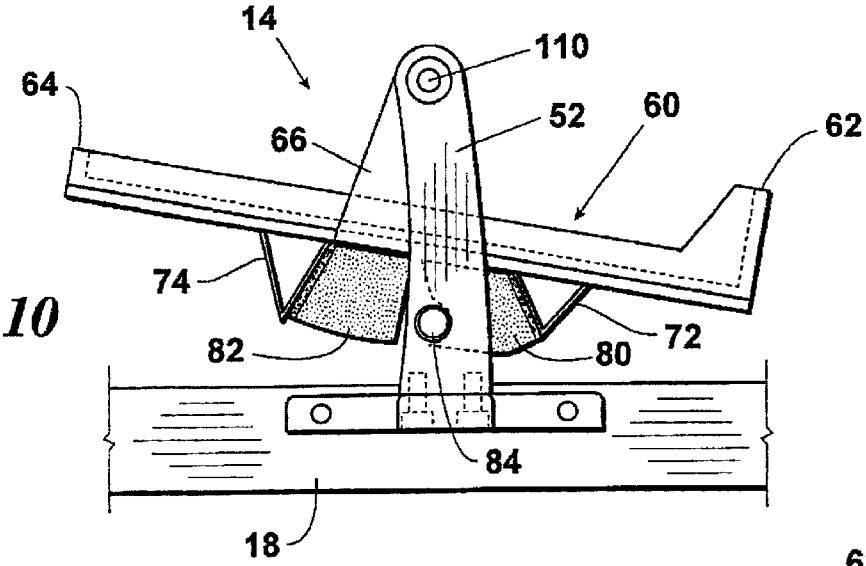
FIG. 10 is a side view of the footbed assembly depicted pivoted such that the toe points downward and the forward pad biased against the shaft.
Figure 11:
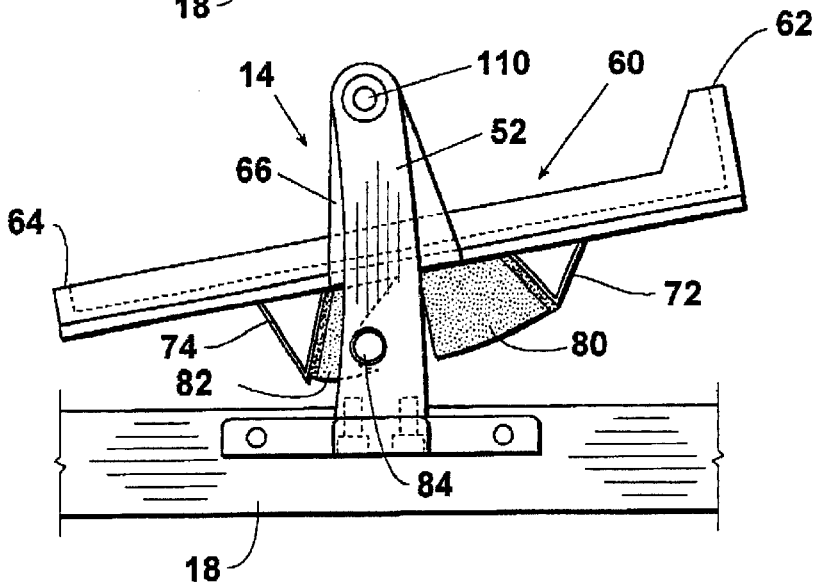
FIG. 11 is a side view of the footbed assembly depicted pivoted such that the heel points downward and the rear pad biased against the shaft.
Figure 15:
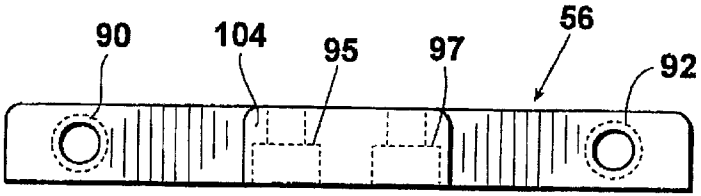
FIG. 15 is a side detail view of the long segment of the plate mount.
Figure 16:
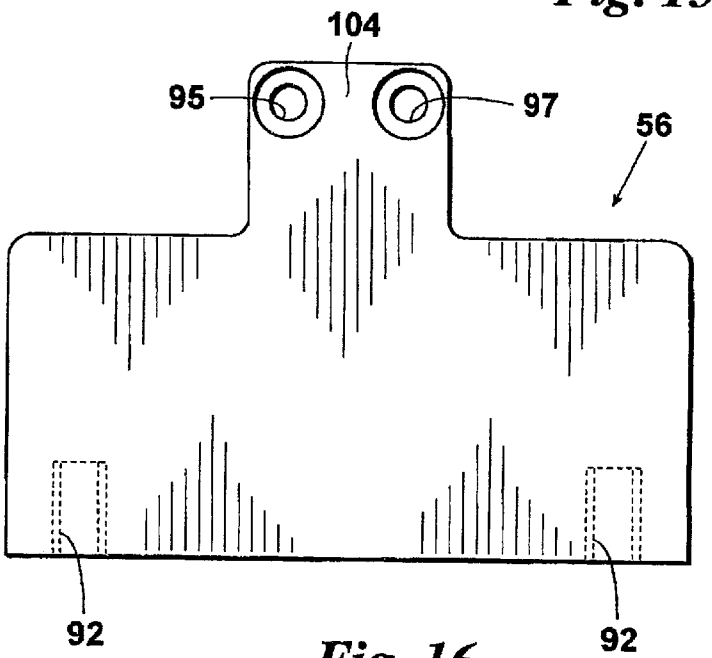
FIG. 16 is a top detail view of the long segment of FIG. 15.
Figure 17:
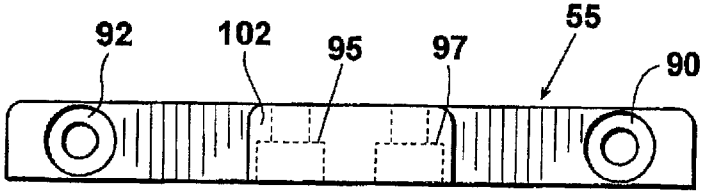
FIG. 17 is a side detail view of the short segment of the plate mount.
Figure 18:
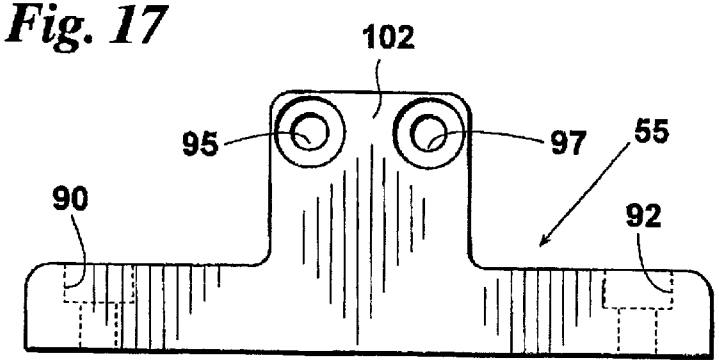
FIG. 18 is a top detail view of the short segment of FIG. 17.

Referring next to FIGS. 9–11, the interrelationship between pads 80, 82 and shaft 84 shall be demonstrated. FIG. 9 depicts footbed assembly 14 in the rest position and is identical to FIG. 15. Pads 80 and 82 bias against shaft 84 to maintain footpad 60 in the rest position.

When footpad 60 is pivoted about pin 110 such that toe 62 is rotated downward toward rail 18, pad 80 is compressed around shaft 84 and against V 72. Pad 82 is completely relaxed. When compressed, pad 80 biases against shaft 84 in an attempt to release energy to extend and force footpad 60 back to the relaxed position of FIG. 9.

When footpad 60 is pivoted about pin 110 such that heel 64 rotates downward toward rail 18 as in FIG. 11, pad 82 is compressed between shaft 84 and V 74. Pad 80 is fully relaxed in this position. When compressed, pad 82 stores energy to force V 74 away from shaft 84 to return footbed 60 to the relaxed position.

In this way, it can be seen that pads 80 and 82 bias in opposite directions such that as footpad 60 is rotated about pin 110, either pad 80 or pad 82 bias against pin 84 in an attempt to return to the rest position of FIG. 9. As a result, pads 80 and 82 cushion footpad 60 in its rotation and prevent footpad 60 from swinging freely about pin 110. A greater sense of control of footpad 60 is thus achieved.

Pads 80 and 82 are constructed of a resilient foam material which has a memory to return to the natural state.

The range of motion of footpad 60 may be unlimited, however, it has been found that a maximum rotation of 10°–15° backward from horizontal is preferred. The forward range of rotation from horizontal is limited only by the physical limit of contact between toe 62 and rail 18 which has been found to be approximately 16° from horizontal. In the range of motion of an elliptical exercise device, it has been found that the forward rotation is not a factor in the biokinetic motion of the foot/ankle through the range of travel of the footpad. 60.

Figure 12:
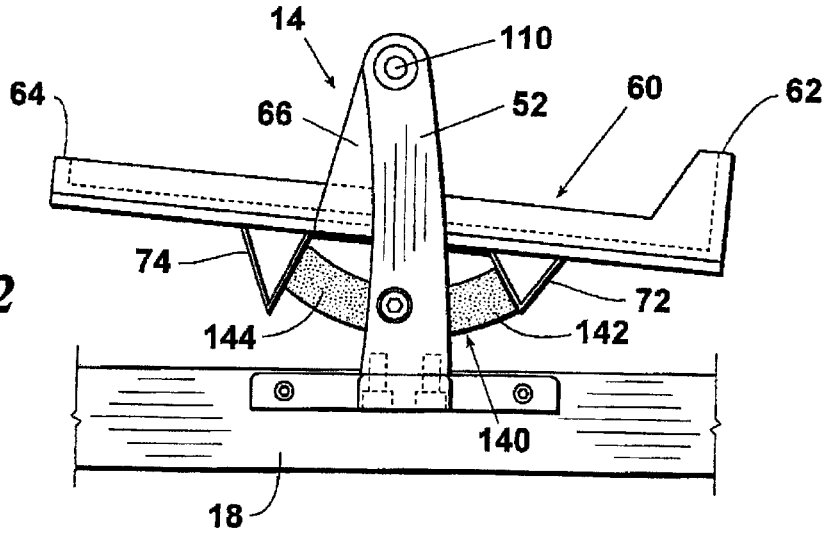
FIG. 12 is a side view of the footbed assembly including the alternate pad design of FIG. 19.
Figure 19:
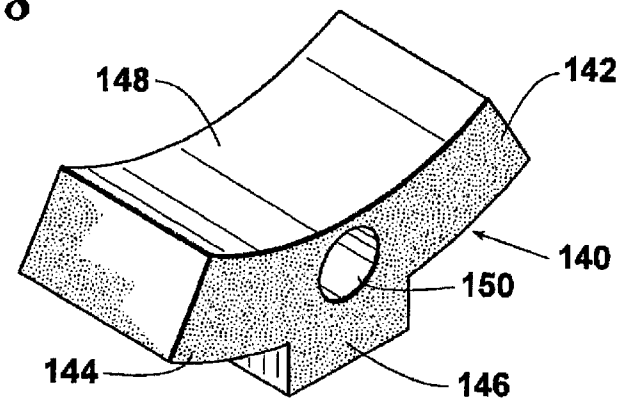
FIG. 19 is an isometric view of an alternate design pad.

FIG. 19 depicts an alternate embodiment wherein the separate pads 80 and 82 are replaced by a single segment pad 140. Pad 140 includes a forward segment 142, a rear segment 144 and a base segment 146. In the preferred embodiment, pad 140 is arcuate in its top contour 148 so that an arc is formed by top contour 148 extending from front V 72 to rear V 74 (as shown in FIG. 12). Pad 140 of FIG. 19 also includes a hole 150 therethrough through which shaft 84 is inserted.

Figure 13:
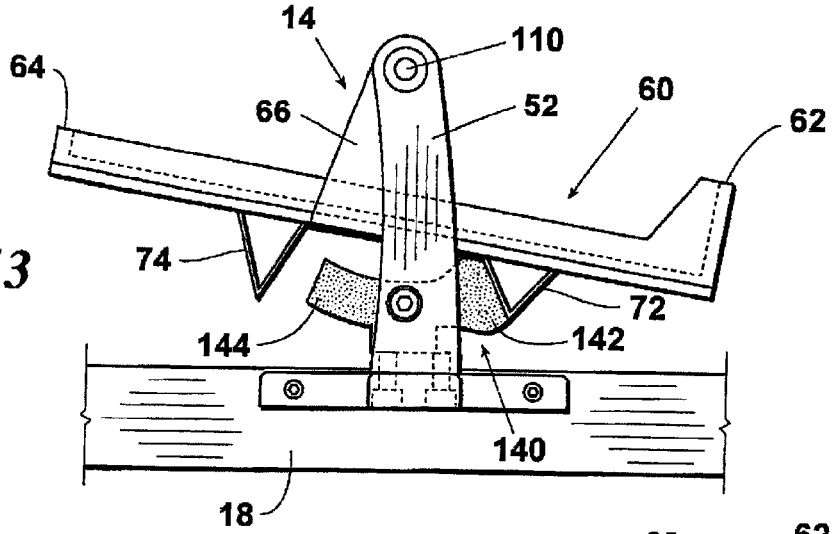
FIG. 13 is a side view of the footbed assembly depicted pivoted such that the toe points downward and the forward segment of the pad biased against the toe "V" of the saddle.
Figure 14:
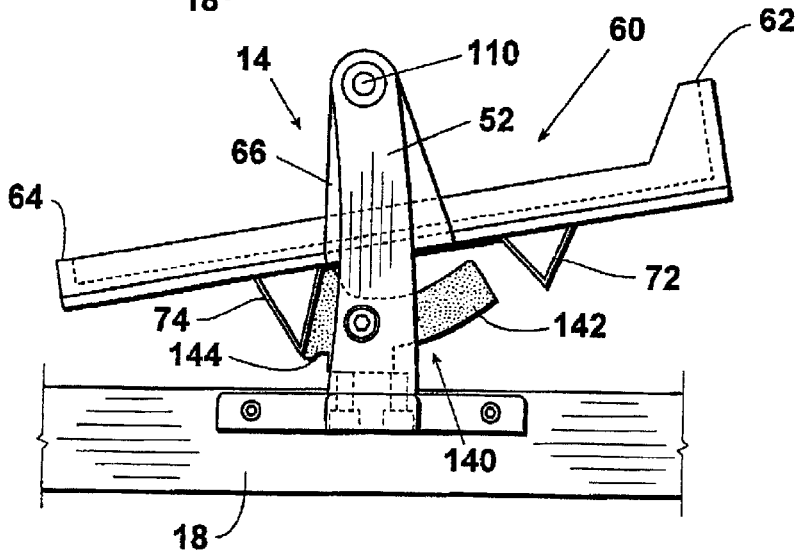
FIG. 14 is a side view of the footbed assembly depicted pivoted such that the heel points downward and the rear segment of the pad biased against the heel "V" of the saddle.

Referring next to FIGS. 12–14, the range of rotation of footbed 60 with pad 140 is depicted. In FIG. 12, pad 140 is shown such that forward segment 142 contacts V 72 and rear segment 144 contacts V 74. As such, forward segment 142 biases against V 72 while rear segment 144 biases V 74 to maintain footpad 60 in the relaxed position of FIG. 12.

In FIG. 13, toe 62 of footpad 60 is rotated toward rail 18 such that forward segment 142 is compressed between shaft 84 and forward V 72. V 74 rotates away from rear segment 144. The compression of forward segment 142 acts to force V 72 away from shaft 84.

In FIG. 14, heel 64 is rotated toward rail 18 such that rear segment 144 is compressed between V 74 and shaft 84. Forward V 72 rotates away from forward segment 142. Compression of rear segment 144 increases the force of rear segment 144 to push V 74 away from shaft 84.

The respective lengths of forward and rear segments 142 and 144 may be modified as the rest position of footpad 60 is changed. As stated above, it is believed that a 5° rotation downward of toe 62 is believed to be the desired rest position.

Figure 2:
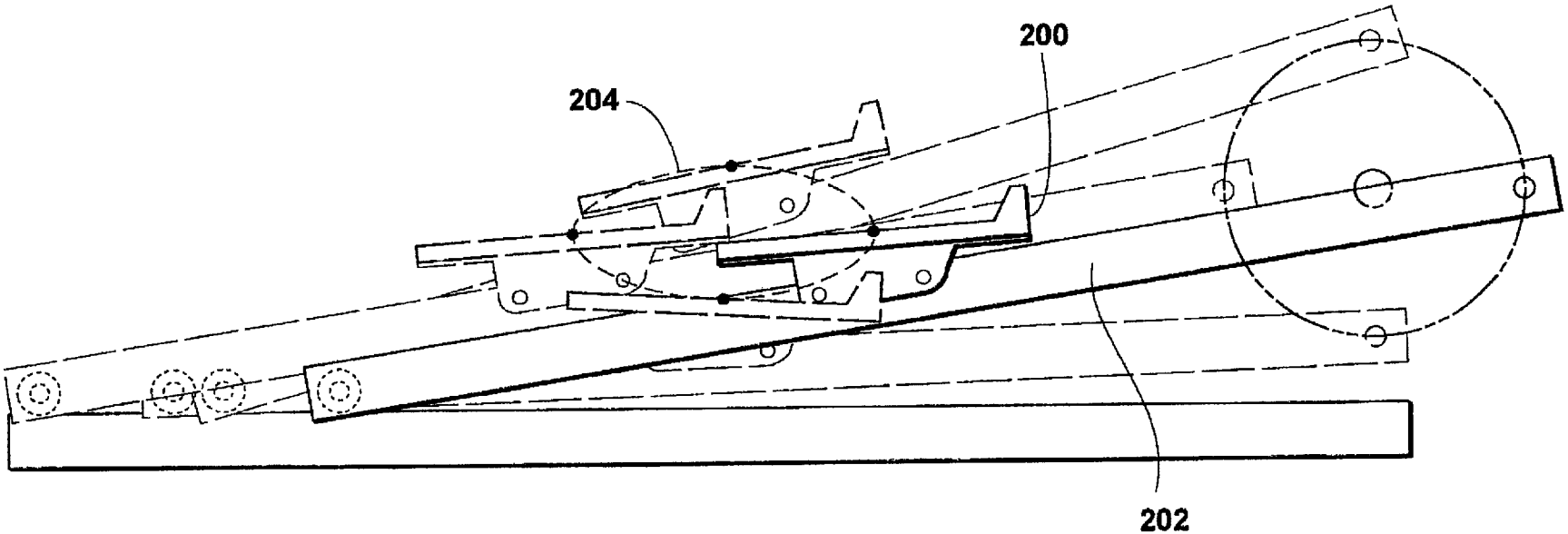
Fig. 2 ( PRIOR ART )
FIG. 2 is a side view representation of the elliptical path of rotation of a prior art fixed footbed assembly.

Reference is next made to FIG. 2 which depicts a prior art fixed footbed assembly 200. Footbed assembly 200 is affixed to rail 202 such that in its path of rotation depicted in four stages in phantom is shown. As can be seen, since footbed assembly 200 is fixed to rail 202, footbed assembly 200 remains at a fixed relationship to rail 202 during the entire path of rotation. The resulting elliptical path of rotation is defined in phantom as 204.

Figure 4:
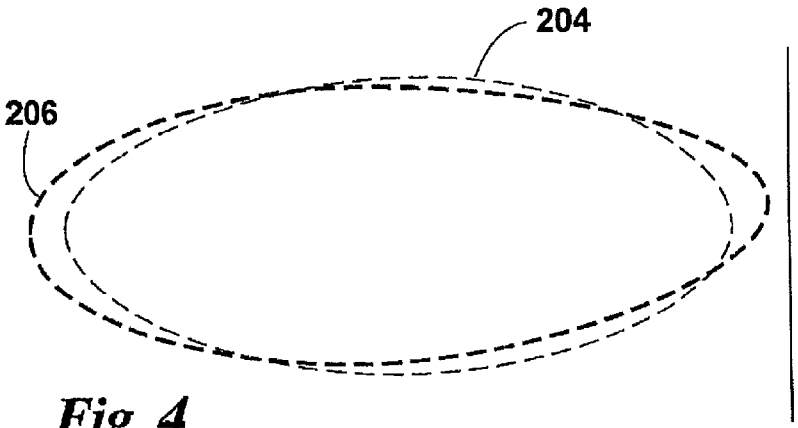
FIG. 4 is an overlay representation of the elliptical path of rotation of the footbed assembly of the present invention overlaid upon the elliptical path of rotation of the prior art footbed assembly of FIG. 2.

In FIG. 3 depicts the footbed assembly 14 of the present invention wherein the footpad is capable of pivoting with respect to rail 18 such that the elliptical path of travel of the footpad is not dictated by the angle of inclination of rail 18. The resulting elliptical path of rotation is shown in FIG. 3 as 206. The resulting elliptical path of rotation thereby follows the natural path of rotation of the user's stride. FIG. 4 depicts elliptical path 206 imposed over elliptical path 204 of the prior art. As can be seen, the elliptical path of rotation of the prior art fixed footbed assembly produces an ellipse that is generally horizontal and results in an unnatural, uncomfortable path of rotation for the user. However, the elliptical path of rotation of the footbed assembly of the present invention 206 is shown to be slightly inclined when superimposed over the prior art 204. As such, elliptical path rotation 206 resembles the natural, comfortable stride of the user.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A footbed for an exercise device having a rail comprising:

a plate mount having a longitudinal axis secured to the top of the rail;

at least two posts;

said posts being secured to opposite ends of said plate mount and extending upwardly therefrom;

a saddle including a bottom surface and at least two wings wherein each of said at least two wings is pivotally connected to one of said at least two posts;

at least two segments secured to and extending from said bottom surface of said saddle;

a saddle pivot limit supported between said at least two segments.

2. The footbed of claim 1 wherein said plate mount is secured asymmetrically to said rail forming a short segment and a long segment of said plate mount.

3. The footbed of claim 1 including a footpad supported from said saddle.

4. The footbed of claim 1 wherein said at least two segments are substantially V-shaped.

5. The footbed of claim 4 further comprising:

a shaft secured beneath said saddle and extending between and secured to said at least two posts;

said shaft extending between said at least two V-shaped segments.

6. The footbed of claim 5 further including a plurality of pads such that a pad is affixed to each of said V-shaped segments between said V-shaped segments and said shaft.

7. A footbed for an exercise device having a rail comprising:

a plate mount secured to the top of the rail such that the longitudinal axis of the plate mount is perpendicular to the longitudinal axis of the rail;

at least two posts;

said posts being secured to opposite ends of said plate mount and extending upwardly therefrom;

a saddle including a bottom surface and at least two wings wherein each of said at least two wings is pivotally connected to one of said at least two posts;

at least two V-shaped segments secured to and extending from said bottom surface of said saddle with a bridge there between;

a shaft secured beneath said saddle and extending between and secured to said at least two posts;

said shaft extending between said at least two V-shaped segments adjacent said bridge a footpad supported from said saddle.

8. The footbed of claim 7 further including a plurality of pads such that a pad is affixed to each of said V-shaped segments between said V-shaped segments and said shaft.

* * * * *